United States Patent [19]

Miyazaki et al.

[11] 3,981,551

[45] Sept. 21, 1976

[54] MEANS FOR TRANSPORTING YARN PACKAGES PRODUCED BY SPINNING MACHINERY

[75] Inventors: Tsutomu Miyazaki, Kariya; Takashi Kato, Toyota; Shozo Ueda, Kariya; Toshio Yoshizawa, Chiryu, all of Japan

[73] Assignee: Kabushiki Kaisha Toyoda Jidoshokki Seisakusho, Kariya, Japan

[22] Filed: Feb. 4, 1975

[21] Appl. No.: 547,092

[30] Foreign Application Priority Data

| | | |
|---|---|---|
| Feb. 8, 1974 | Japan | 49-16629 |
| Feb. 8, 1974 | Japan | 49-16630 |
| Feb. 14, 1974 | Japan | 49-17933[U] |
| Feb. 18, 1974 | Japan | 49-19398[U] |
| Feb. 20, 1974 | Japan | 49-20911[U] |

[52] U.S. Cl. ..... 312/250; 312/252; 312/71; 220/23.4

[51] Int. Cl.[2] ..... A47F 1/00; B65G 1/00; A47B 49/00

[58] Field of Search ..... 312/250, 252, 202, 71, 312/201, 319, 125; 220/23.4

[56] References Cited

UNITED STATES PATENTS

| | | | |
|---|---|---|---|
| 168,448 | 10/1875 | Butterfield et al. | 312/202 |
| 629,367 | 7/1899 | Huxford | 312/252 |
| 794,418 | 7/1905 | Manwiller | 312/125 |
| 1,193,203 | 8/1916 | Taliaferro | 312/71 |
| 1,258,276 | 3/1918 | Turcek | 312/250 |
| 1,283,482 | 11/1918 | Durkee | 220/23.4 |
| 1,575,988 | 3/1926 | Moller | 312/125 |
| 1,616,071 | 2/1927 | Waldheim | 312/250 |
| 1,690,394 | 11/1928 | Belt | 312/250 |
| 1,977,092 | 10/1934 | Scurlock | 220/23.4 |
| 2,209,294 | 7/1940 | Froelich | 312/250 |
| 2,362,331 | 11/1944 | Weber | 220/23.4 |
| 2,589,526 | 3/1952 | Barker | 220/23.4 |
| 2,673,778 | 3/1954 | Wood | 312/125 |
| 2,702,641 | 2/1955 | Arthur | 220/23.4 |
| 2,879,122 | 3/1959 | Maves | 312/71 |
| 3,589,787 | 6/1971 | Messersmith | 312/319 |
| 3,612,457 | 10/1971 | Morikawa | 312/71 |
| 3,627,395 | 12/1971 | Hoey | 312/215 |
| 3,801,176 | 4/1974 | Higbee | 312/201 |

FOREIGN PATENTS OR APPLICATIONS

| | | | |
|---|---|---|---|
| 942,960 | 11/1963 | United Kingdom | 312/71 |

*Primary Examiner*—Paul R. Gilliam
*Assistant Examiner*—Victor N. Sakran
*Attorney, Agent, or Firm*—Wenderoth, Lind & Ponack

[57] ABSTRACT

A yarn package transportation vehicle comprises a turnable table having a plurality of cylindrical containers arranged in circle thereon. Yarn packages produced by a spinning machinery are canistered in the containers. The vehicle is positioned adjacent to one end of the spinning machinery so that one of the canisters is set in a canistering position in which the canister receives the yarn packages therein. When one container is fully loaded with the yarn packages, adjacent container is readily brought into the canistering position by turning the table a predetermined angle.

10 Claims, 26 Drawing Figures

FIG. 12(a)
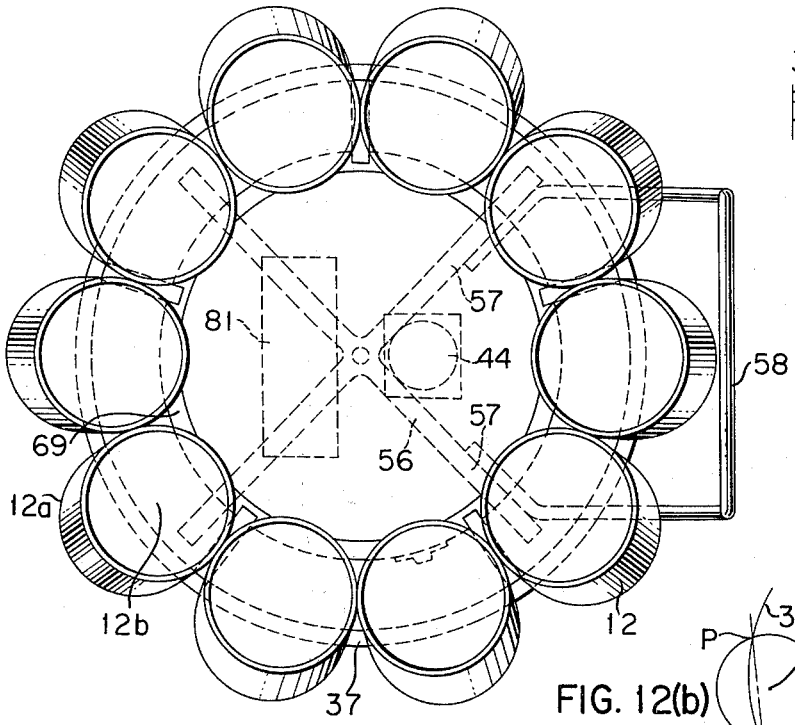
FIG. 16
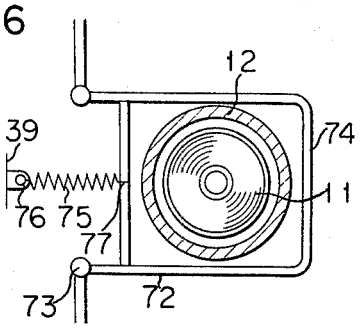
FIG. 17
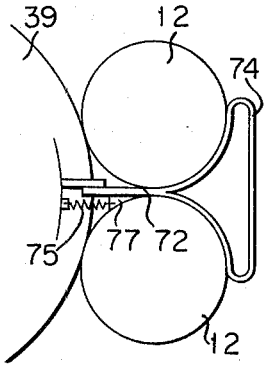
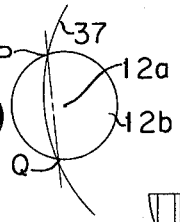
FIG. 12(b)
FIG. 19(a)
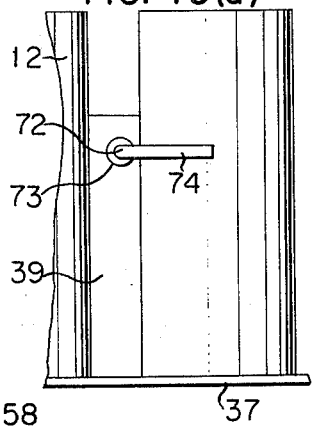
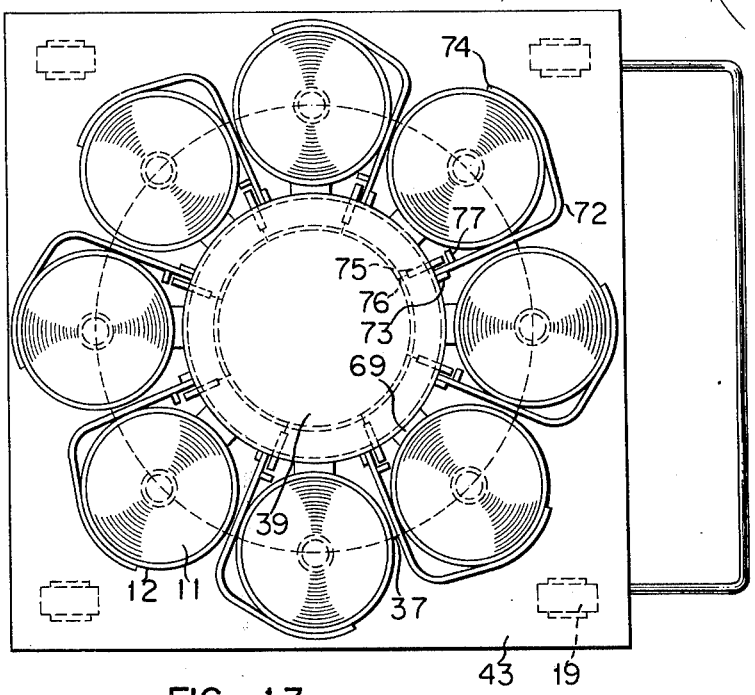
FIG. 13
FIG. 19(b)
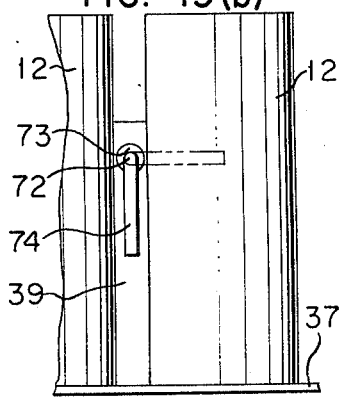

MEANS FOR TRANSPORTING YARN PACKAGES PRODUCED BY SPINNING MACHINERY

BACKGROUND OF THE INVENTION

This invention relates to means for transporting yarn packages produced by a spinning machinery, such as a spinning frame, a double twister, a false twisting machine, or a winder.

In an open end spinning frame, for example, a series of spinning units are arranged between head stocks wherein drive motors, gear boxes and control mechanisms are located. A sliver from each can is spun by a spinning device of the spinning unit into a yarn which is, in turn, taken up by a spun yarn take-up roller and wound through a grooved winding roller on a bobbin to be formed into a yarn package or cheese. Each cheese is doffed and transported to a separate apparatus to be subject to the next processing step of the spinning. Heretofore, in order to transport the cheeses from the spinning frame to the separate apparatus, various transporting systems have been provided.

For example, in the case of an open end spinning frame of the type wherein a conveyor is provided therealong to transfer the doffed cheeses to one end of the spinning frame, the cheeses have been handled by either a transporting system that they are contained in suitable containers at the end of the spinning frame and then a vehicle transfers some of the containers to the subsequent processing station or a transporting system that they are transferred onto a conveyor system fixedly arranged to extend from the spinning frame end to the subsequent processing position, whereby the cheeses are transported one by one or in groups to the subsequent processing position.

In the former system especially in the case of the yarn packages in the form of a cheese having a comparatively large dimension and weight, such as those produced by the spinning frame, since the packages are canistered at random in the container, they may be damaged and effective utilization of the capacity would not be expected. In the latter system, not only the installation position of the conveyor system is apt to be subject to restrictions due to the presence of other equipment, but such a permanent installation of the conveyor system may cause an undesirable operation of the conveyor system in view of accumulation of flies in the room.

Furthermore, in the former transporting system, in order to stop the vehicle the correct position at the spinning frame end, the operator has had to judge with his own eyes whether or not the vehicle is in the correct position. Therefore, this method of positioning the vehicle can not always achieve good results and a smooth transfer of the cheeses from the spinning frame to the container on the vehicle cannot be accomplished. The operator may be required to repeat the positioning of the vehicle several times to stop it at the correct position. In order to eliminate the above disadvantages due to the judgement by the operator's eyes, a device has been proposed which comprises a pin extending from the vehicle and a complementary hole provided in a floor to receive the pin, thereby facilitating the positioning of the vehicle. However, this device further requires means for operating the pin to bring it into and out of the hole, and it is difficult to check whether the pin is brought into engagement with the hole and to effect the engagement of the pin with the hole.

SUMMARY OF THE INVENTION

It is accordingly a primary object of the invention to provide a yarn package transportation vehicle which can transport the yarn packages in a systematic order.

It is another object of the invention to provide a yarn package transportation vehicle with a positioning device which is free of trouble and can stop the vehicle at a predetermined position with ease and high accuracy in spite of its simple construction.

It is a further object of the invention to provide a yarn package transportation vehicle having means for preventing lateral movements of the canisters mounted on the vehicle which contain the yarn packages.

With the above object in view, the invention provides means for transporting yarn packages contained in a plurality of containers with open and closed ends, characterized in that the containers are arranged in a circle on a turnable table of the vehicle with their open ends above the closed ends. When it is desired to load the particular container with the packages, the table is rotated to bring the particular container into the canistering position where the particular container is coincident in position with the final feed end of the spinning machinery at which the packages leave the spinning machinery, whereby the packages are allowed to fall into the particular container. The falling of the packages can be easily effected automatically. The circular arrangement of the containers allows each of the containers to be positioned successively at the close correct position with respect to the final feed end of the spinning machinery by merely rotating the table a predetermined angle and also makes it possible to load and unload the container from every side of the vehicle. In addition, the circular arrangement of the containers provides the vehicle with a center space. In the preferred embodiment, the vehicle comprises a mechanism for turning the table. Since the table-turning mechanism can be provided in the center space defined by the circularly arranged containers, the overall size of the vehicle is diminished, and the vehicle becomes compact. It is noted that the turning table allows the empty containers thereon to be successively moved in their correct position more easily and quickly.

According to the invention, the containers may be arranged in a circle so as to incline inwardly of the vehicle. This allows the containers to be supported tightly on the vehicle at their inner parts of the bottoms of the containers without the need for supporting the outer parts of the container bottoms, and therefore, it is possible to decrease a diameter of an element which carries the containers, thus resulting in a compact vehicle.

Alternatively, according to the invention, the vehicle may comprise means for preventing lateral movement of the containers while tightly holding the containers.

BRIEF DESCRIPTION OF THE DRAWINGS

The invention will become more readily apparent from the following detailed description taken in conjunction with the accompanying drawings in which, for simplicity of illustration, like numerals designate like parts throughout the various figures and in which:

FIG. 12(*a*) is a plan view of FIG. 11, on a reduced scale;

FIG. 12(*b*) is a view illustrating the relationship between a turning table and a bottom of the container;

FIG. 13 is a plan view corresponding to that of FIG. 12(*a*), showing a still further embodiment of the invention;

FIGS. 16 and 17 are views showing different modifications of means for preventing lateral movements of the canisters;

FIGS. 19(*a*) and 19(*b*) are views illustrating a construction and an operation of means for preventing lateral movements of the canisters, which is used with vehicle of FIG. 18;

DESCRIPTION OF THE PREFERRED EMBODIMENTS

Figure 1:
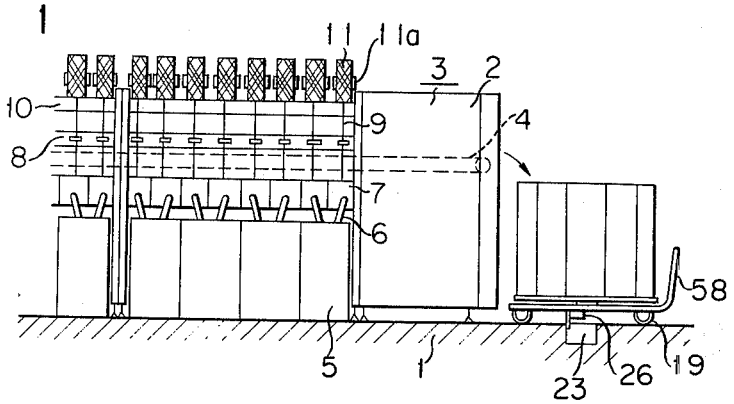
FIG. 1 is a fragmental front view of an open end spinning frame to which a yarn package transportation vehicle of the invention is applicable.

Referring now to FIG. 1, a conventional open end spinning frame is shown positioned on a floor 1. Although the following description is made with respect to a particular type of spinning machine, that is an open end spinning frame, the invention is of course not limited thereto. In FIG. 1, a series of spinning devices 7 are arranged between opposite head stocks 2 (only one is shown for simplification) in a conventional manner. A sliver 6 from each can 5 is spun by the associated spinning device 7 into a yarn 9 which is then taken up by a spun yarn take-up roller 8 and wound through a winding roller 10 on a bobbin 11*a*, thus forming into a cheese or yarn package 11. The formed cheeses 11 are doffed from the spinning frame 3 onto a belt conveyor 4, which centrally extends along the spinning frame 3. The cheeses are thus moved to one end of the spinning frame 3 at which point they leave the spinning frame and fall into canisters or containers 12 of a yarn package transportation vehicle 13 according to the invention. Regarding the vehicle 13, the detailed description will be made hereinafter.

Figure 3:
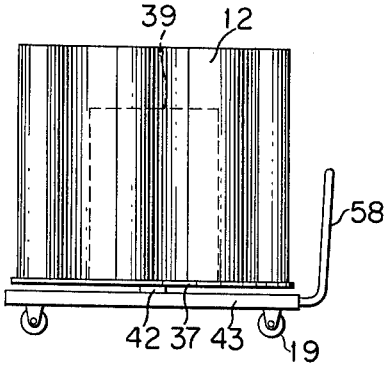
FIG. 3 is an enlarged view of the vehicle shown in FIG. 2.

As shown in FIG. 3, the cheese transportation vehicle 13 is provided at the bottom with wheels 19 to facilitate its movement on the floor 1. The vehicle 13 may be actuated by an operator or a motor driven traction car (not shown). Disposed on the vehicle 13 are a plurality of cylindrical cheese containers or canisters 12, each formed in a cylindrical shape similar to the can 5 with the inner diameter slightly larger than the outer diameter of the cheese 11. Within each of the containers 12, a cheese receiving plate 20 (see FIG. 11) is carried for upward and downward movements by a resilient means consisting of a coil spring 21, disposed between the plate 20 and the bottom of the container and normally urging the cheese receiving plate 20 upwardly. It is preferable that the coil spring 21 have a suitable spring constant which allows the height of the coil spring to just change for an amount corresponding to the length of the bobbin 11*a* every time one cheese is taken out of or deposited in the container, since this facilitates the taking out of the cheeses 11. The cheeses 11 are canistered in the container 12 with their bobbins 11*a* arranged in an end-to-end contacting relationship. In the embodiment illustrated, each container 12 can contain a maximum number of five cheeses and each vehicle 13 can ride six containers 12 thereon. Therefore, the number of cheeses 11 carried by one vehicle is 30, but the invention is not limited thereto.

The cheeses 11 produced by the open end spinning frame 3 are transferred to the spinning frame end by the conveying means 4 installed in the spinning frame 3 and hence into the containers 12 on the cheese transportation vehicle 13, located at a canistering position near the spinning frame end in the aforementioned manner thereby allowing the bobbins 11*a* to be in end-to-end contact relationship. It is preferable that each transportation vehicle 13 be capable of being loaded with a number of cheeses 11 equal in to or greater than the number produced on one or both sides of each spinning frame. Then (the cheese transportation vehicle 13 loaded with the cheeses, the number of which corresponds by way of example to that of the spinning units of one spinning frame) is transported to a separate apparatus not shown. In this case, the cylindrical interior of the container provides the minimum space for accumulating the cheeses and makes it possible even if the cheeses contact the surface of the container interior, for contact to be made along straight lines. This has no substantial affect on the steam setting process.

Figure 6:
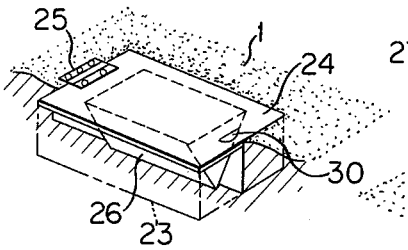
FIG. 6 is a perspective view of one element forming a part of a vehicle positioning device, the element being in an inoperative position.
Figure 7:
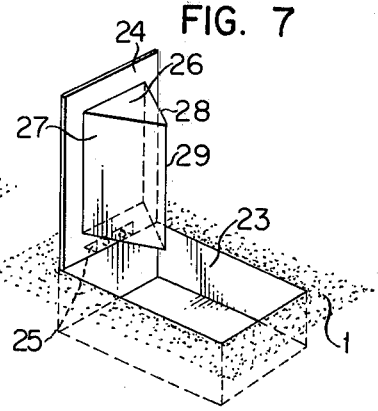
FIG. 7 is a view of the element of FIG. 6, but in an inoperative position.
Figure 8:
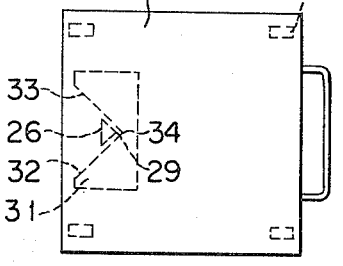
FIG. 8 is a view diagrammatically showing a relation between the element shown in FIGS. 6 and 7 and the yarn package transportation vehicle.

Referring to FIG. 1 and to FIGS. 6 and 7, a device for automatically locating the vehicle 13 at the canistering position near the spinning frame end is also shown. The device comprises a hole 23 in the floor 1 and a cover plate 24 attached to the floor 1 by a hinge 25 to selectively close the hole 23. On the inner side of the cover plate 24, a first positioning member 26 in the form of a triangular prism which has symmetrically inclined surfaces 27 and 28 as shown in FIGS. 6 and 7 is securely mounted. In the closed condition shown in FIG. 6, the positioning member 26 is housed in the hole 23 and in the open condition of the same (FIG. 7), the positioning member 26 is out of the hole 23 and a boundary 29 between the inclined surfaces 27 and 28 extends substantially upright. A notch 30 is provided in the cover plate 24 to facilitate the opening of the cover plate 24. The device further comprises a second positioning member 31 (FIG. 8) provided on the under side of the vehicle 13. The second positioning member 31 is of one-piece integral formation and has a shape complementary to the prism 26 so that when the first positioning member 26 is in the operative position (FIG. 7), one of the positioning members 26 and 31 can be nested in the other as shown in FIG. 8. That is, the second positioning member 31 also has inclined surfaces 32 and 33 engageable respectively with the surfaces 27 and 28 of the first positioning member 26.

In order to stop the vehicle 13 correctly at the canistering position, all that is needed is to bring the first positioning member 26 into the operative position by opening the cover plate 24 before the vehicle 13 comes near that position. When the vehicle 13 further moves towards the first positioning member 26 in the operative position, the surfaces 32 and 33 of the second positioning member 31 come into contact with the surfaces 27 and 28. The vehicle 13 is then allowed to move until the boundary 29 engages a boundary 34 between the surfaces 32 and 33 of the second positioning member 31. Thus, the vehicle 13 is correctly stopped at the canistering position.

Figure 9:
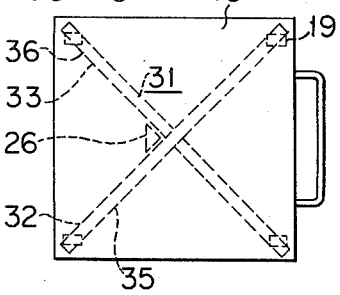
FIG. 9 is a view corresponding to that of FIG. 8, showing a different modification of the invention.
Figure 10:
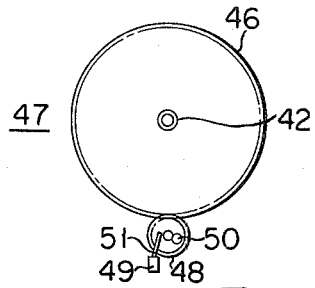
FIG. 10 is a plan view showing a gear type mechanism for detecting a changed amount of an angular position of a turning table comprising the vehicle of FIG. 3.

FIG. 9 shows a different modification of the vehicle positioning device, which is the same as the device shown in FIGS. 6 to 8 except that the second positioning member 31 comprises a pair of crossed bars 35 and 36 having inclined surfaces 32 and 33.

It is noted that the first positioning member 26 is brought out of the hole 23 only when the vehicle 13 is to be stopped at the canistering position; it does not therefore interfere with any of operator's work. In addition, since the position where the vehicle is to be stopped is maintained constant at the canistering position by the positioning device of the invention, there is no fear that the vehicle will abutt against the spinning machinery during the vehicle stopping operation. This prevents a jolt from being given to the spinning machinery and the vehicle.

It is apparent that the second positioning member may be in the form of a triangular prism and in this case the first member has a portion receiving the triangular prism.

In the embodiment of the invention shown in FIGS. 3 to 5 and 10, the cheese transportation vehicle 13 (which is not provided with the vehicle positioning device) comprises a turning table 37 on which a plurality of canisters 12 are arranged in circle. For causing the table 37 to turn, a driving mechanism 38 is provided within a casing 39 which is fixedly mounted on the table 37 in a substantially cylindrical space 40 defined by the circularly arranged canisters 12 and the table 37. The table 37 is supported for rotation by bearing means 41 fitted onto a center pillar 42, which is fixed to the base 13 and extends therefrom upwardly through the table 37 and the bearing means 41. The table driving mechanism 38 includes a motor 44, which is normally a battery driven motor, supported by the pillar 42, and a train of gearings arranged between the motor 44 and the table 37 to transmit rotation of the motor 44 to the table 37. The train of gearing comprises a gear 45 mounted on an output shaft of the motor 44 and a gear 46 which is generally an integral part of the table 37.

When one canister 12 is fully loaded with the predetermined number of cheeses 11, the table 37 is turned to bring the next empty canister 12 into a predetermined position immediately near the spinning frame end. It is preferable that the vehicle 13 be provided with a device 47 for controlling an amount of rotation of the table 37. Such a control device 47 is shown by way of example in FIG. 10.

The control device 47 comprises a gear 48 meshing with the gear 46 of the table driving mechanism 38. The number of teeth of the gears 46 and 48 are in a relationship wherein when the next empty canister 12 is placed in the predetermined position by turning the table 37, the gear 48 just makes one complete revolution. In this embodiment wherein the vehicle 13 carries eight canisters 12, when the gear 46 is turned an angle of 360/8 or 45 degrees, the gear 48 makes one complete revolution. The control device 47 further includes a switching means 49 and means 50 for operating the switch 49. The switch operating means 50 is normally a projection extending from the gear 48 and on its way of rotation a switch lever 51 of the switch 49 lies. Therefore, the switch 49 is operated for each complete revolution of the gear 48 to cause the motor 44 to be deenergized, thus allowing the table 37 to stop when the next empty canister 12 reaches the predetermined position.

Figure 2:
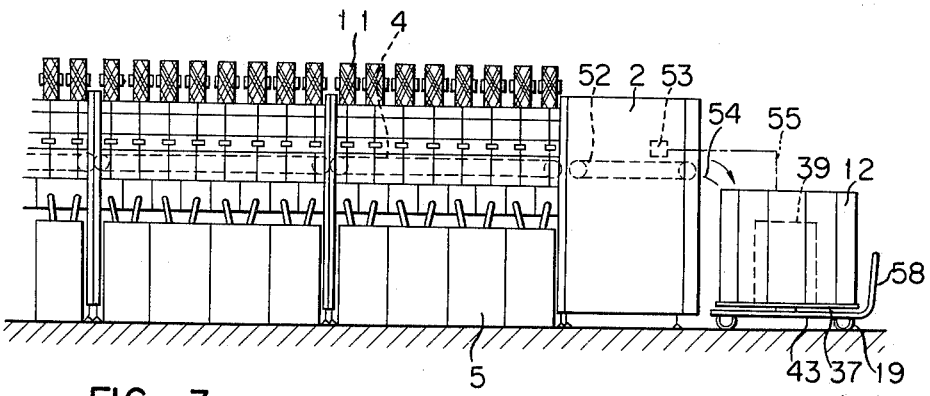
FIG. 2 is a view similar to FIG. 1, showing a different modification of the invention.
Figure 4:
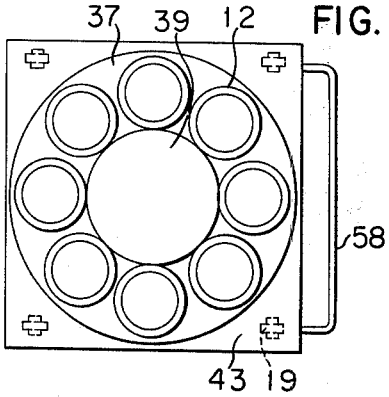
FIG. 4 is a plan view of FIG. 3.
Figure 5:
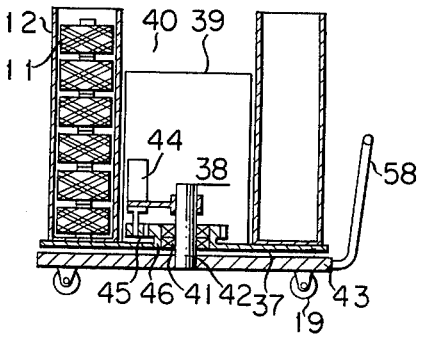
FIG. 5 is a section of the vehicle shown in FIG. 3.

The canistering operation of feeding the cheeses into the canister 12 on the vehicle 13 shown in FIGS. 3 to 5 is carried out in the following manner. When the cheeses 11 attain their predetermined diameter they are doffed from the associated holders of the spinning machinery by either the manipulation by the operator or the automatic doffing machine (not shown) onto the conveying means 4 (FIG. 2) which transfers the doffed packages 11 onto a belt conveyor 52 disposed within the head stock 2. Also mounted within the head stock 2 are means 53 for detecting the cheeses 11 running along with the belt conveyor 52, and means 54 arranged near the coming out end of the belt conveyor 52 for guiding the cheeses 11 leaving the belt conveyor 52 to be correctly in the desired manner into the associated canister 12 preliminarily set in the predetermined canistering position for the canistering. The number of cheeses 11 canistered in the associated canister 12 is detected by the detecting means 53. When the detected number reaches a predetermined value (six, in this embodiment), that is when the canister 12 becomes full of the cheeses, the detecting means 53 transfers a signal through a line 55 to the table driving motor 44, to start up the motor 44. Thus, the motor 44 turns the table 37 through an angle of 360/8 (45) degrees and brings the next empty canister into the predetermined canistering position. This procedure is repeated until all the canisters are full. It is stated that all the packages held on either one or both of the sides of the spinning frame be carried by one vehicle, because this readily improves the control of yarn quality ready.

Figure 11:
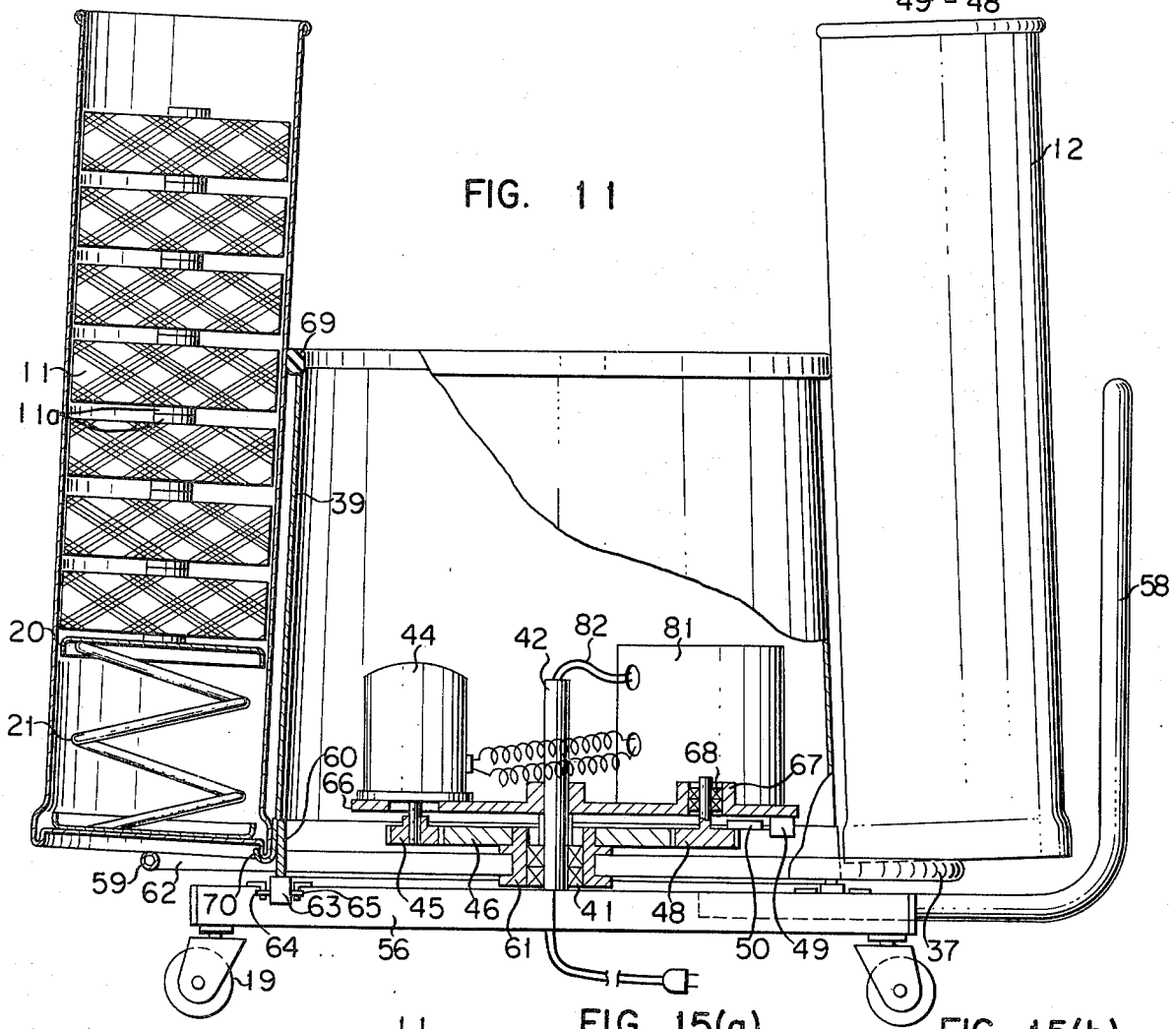
FIG. 11 is an enlarged section of a different vehicle of the invention, with parts broken away for convenience of illustration.

Referring now to FIGS. 11, 12(*a*) and 12(*b*), a still further modification of the invention is shown. In FIG. 11, a yarn package transportation vehicle 13 comprises a cross framework 56 provided on its under side with wheels 19 and at its crossed arms 57 with a handle 58 for convenience of movement thereof. A commercially available caster may be used as the wheel 19. It is preferable that at least one of the wheels 19 be provided with a brake (not shown) for the stopping the vehicle. A turning table 37 on the vehicle 13 is supported for rotation through bearing means 41 by a pillar 42 as in the embodiment of FIGS. 3 to 5. The table 37 comprises an outer annular member 59 having a circular cross-section, an inner annular or cylindrical member 60, a boss 61 fitted onto the bearing means 41, and a plurality of connecting bars 62 extending radially outwardly from the boss 61 through the inner annular member 60 to the outer annular member 59 to connect them with each other. The inner annular member 60 is carried by bearing rollers 63 provided in position in the respective arms 57 of the framework 56. Thus, a major part of the load of the canisters, packages and others is transferred through the inner annular member 60 to the rollers 63. Each roller 63 has a center pin 64 extending from the opposite ends thereof. The pin 64 is supported at its opposite end portions through brackets 65 by the arm 57. A driving motor 44 is mounted on a plate member 66 fixed onto the pillar 42 and drives, through a gear 45, a gear 46 fixedly mounted onto the boss 61. Therefore, upon energization of the motor 44, the table 37 rotates. The plate member 66 has a hollow cylindrical portion 67 defining a space in which bearing means 68 is disposed to support a gear 48 for rotation. The gear 48 meshes with the gear 46 and is adapted to make ten revolutions for each one complete revolution of the gear 46. A switch operating means 50 is provided on one side of the gear 48 to extend radially outwardly from the gear 48 to operate a switching means 49 mounted on the underside of the member 66. The members 44, 45 and 46 compose a table driving mechanism 38 and the members 48, 49 and 50 compose a control device 47 for controlling an amount of rotation of the table 37. A casing 39 is connected to the inner annular member 60 so that it does not fly free from the driving mechanism 38 and the control mechanism 47. The casing 39 is in the form of a conical frustum which is provided along the upper circumferential edge with a ring member 69 made of elastic material, such as rubber, to absorb any shock applied thereto. A plurality of canisters 12 are arranged in circle on the table 37 with their cylindrical surfaces against the ring member 69. Within each canister 12 an ordinary spring 21 is mounted for the purpose described with respect to the abovementioned embodiment. In this embodiment, since the casing 39 is formed in the conical frustum, the canister 12 can be arranged in an inclined relationship. Under the condition that each canister 12 is placed on the table 37, as shown in FIG. 12*a*, a center 12*a* of a flanged bottom 12*b* of each canister 12 is slightly inside a circle defined by the outer annular member 59. That is, in FIG. 12*b*, the center 12*a* is within a chord PQ on which the associated canister 12 is placed. This causes the support of each canister to be stable. The casing 39 is so dimensioned that when all the ten canisters 12 are disposed on the table 37, the adjacent canisters are adapted to tangentially contact with each other at their upper peripheral edges. This also causes the support of the canisters to be highly stable. It is of course a fact that such support relationships between the associated elements can be maintained even after the canistering of the packages into the canisters.

In FIG. 11, a plurality of hook members 70 (in this embodiment, although ten hooks are provided, only one is shown for simplification) are circumferentially spaced around the lower end portion of the casing 39 so as to be engageable with flanges of the bottoms 12*b* of the respective canisters 12. A reference numeral 81 shows an electrical control box and 82 an electric wire. These elements 81 and 82 are utilized to control the table driving mechanism 38 and the control device 47 in the aforementioned manner.

FIG. 13 shows a plan view of a vehicle 13 which is a modification of the vehicle shown in FIGS. 3 to 5. The vehicle 13 of FIG. 13 is the same as that of FIGS. 3 to 5 except that it is provided, for each canister 12, with means 71 for preventing lateral movement of the canister 12. The means 71 does not interfere with the loading and unloading of the canister and allows the loading and unloading of the canisters to be performed with ease.

Figure 14:
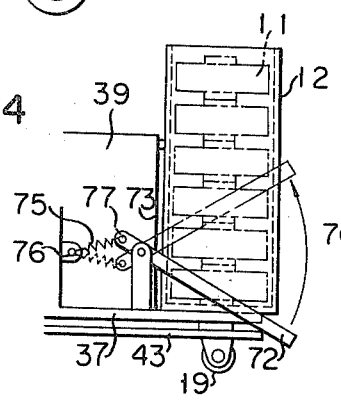
FIGS. 14 and 15(*a*) and 15(*b*) are views illustrating a construction and operation of means for preventing lateral movements of the canisters, which is used with the vehicle of FIG. 13.

Each of the preventing means 71 comprises a holder member 72 attached to the body of the casing for pivotal motion on a pin 73. The holder member 72 extends radially outwardly between the adjacent canisters and then turns in one direction to come in contact with the associated canister 12. The end portion of the holder member 72 is preferably bent as shown at 74 to have a radius of curvature substantially equal to a radius of the canister. A spring 75 is mounted between a stationary portion 76 and a movable portion 77 of the holder 72 to cause the latter to be forced in either the upward or downward position, thereby conveniently holding the associated canister 12 against an elastic member 69. When the holder 72 is turned downwardly off of dead center, it is maintained, as shown by the solid line in FIG. 14, in a position below the level of the canister bottom so that no interference occurs in the loading and unloading of the canister. In FIG. 14, the spring 75 is a compression spring.

Figure 15A:
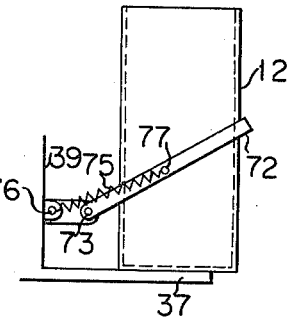
Figure 15B:
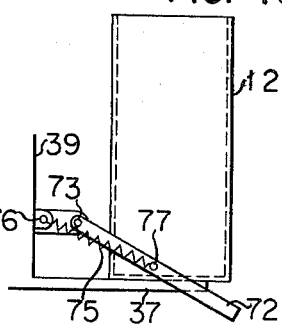

FIGS. 15*a* and 15*b* show fragmentary side views of FIG. 13, on a restricted scale, but different in a manner of mounting the holder 72.

FIG. 16 shows a modified holder 72 in the form of a rectangular frame, which is on dead center. An engaging portion 74 of the holder 72 may have a radius of curvature substantially equal to a radius of the canister.

FIG. 17 shows a still modified holder 72 having two engaging portions 74 extending in opposite directions to hold the adjacent canisters by the single holder. The holder 72 may have long engaging portions 74, each of which holds two or more canisters.

Figure 18:
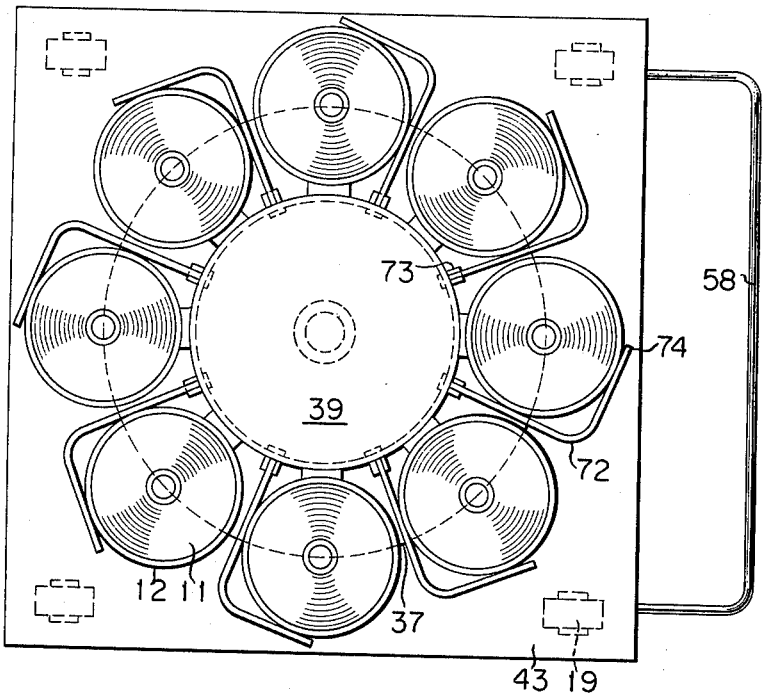
FIG. 18 is a view corresponding to that of FIG. 13, showing a still further modification of the invention.

FIG. 18 is a view corresponding to that of FIG. 13, showing a still further modified holder 72 which is adapted to be turnable in FIG. 19 in the clockwise and counterclockwise directions, but not in the upward and downward directions as the holder of FIGS. 13 to 17.

When the holder 72 is in a horizontal operative position shown in FIG. 19*a*, the engaging portion 74 of the holder 72 engages the associated canister to hold it tight. When the holder 72 in the horizontal position is turned in the clockwise direction to a perpendicular inoperative position shown in FIG. 19*b*, the engagement of the holder 72 with the associated canister is released, thus allowing the loading and unloading of the canister without causing any interference.

Figure 20A:
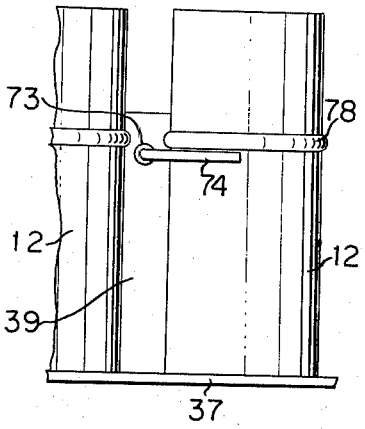
FIGS. 20(*a*) and 20(*b*) are views corresponding to those of FIGS. 19(*a*) and 19(*b*), showing a different modification of the invention.
Figure 20B:
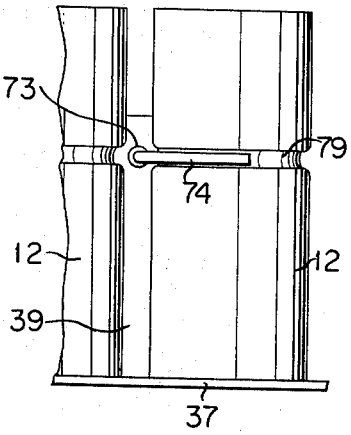

As shown in FIGS. 20*a* and 20*b*, the canister 12 may be provided with a circumferential convex portion 78 or a circumferential concave portion 79 at a position near or coincident with the horizontal operative position of the holder 72 to facilitate the holding of the canister. It is noted that the convex portion 78 or concave portion 79 may be provided in a separate annular member disposed around the canister. Such a convex or concave portion prevents the unexpected release of the holder 72 due to, for example, vibrations of the canister which may occur during transportation thereof.

Figure 21A:
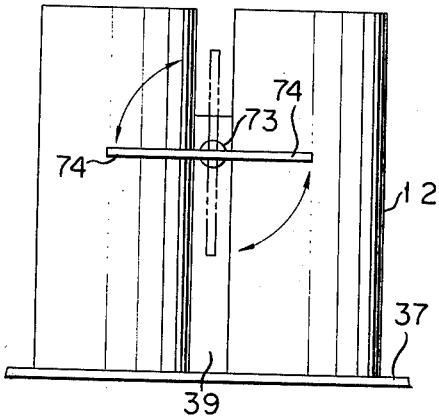
FIGS. 21(*a*) and 21(*b*) are views corresponding to those of FIGS. 19(*a*) and 19(*b*), showing a still different modification of the invention.
Figure 21B:
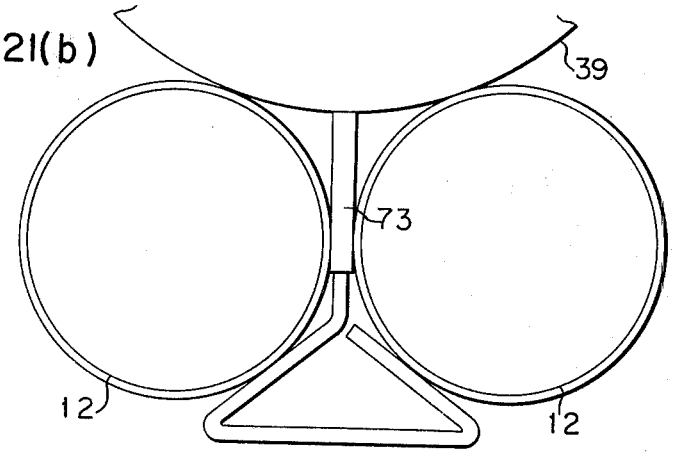

In addition, similar to the holder 72 shown in FIG. 17, a holder 72 of FIGS. 21*a* and 21*b* can hold two canisters. In this embodiment, the holder 72 is mounted to the casing 39 against movement, but an engaging portion 74 in the form of a triangle is turnable between the horizontal operative position shown in FIG. 21*b* and the perpendicular inoperative position shown in FIG. 21*a* with respect to the holder 72.

What is claimed is:

1. A device for receiving and transporting a plurality of yarn packages produced by a spinning machine in the form of relatively large diameter cylinders with center bobbins, said device comprising:

a base;

canister means for containing said yarn packages therein with said center bobbins contacting each other, said canister means comprised of:

a plurality of individual cylindrical containers positioned in a circular arrangement about a central axis, said containers having unobstructed open tops for receiving said yarn packages therethrough and closed bottoms, movable plate means fitted within each container for supporting said yarn packages thereon, and resilient member means in each container between said movable plate and the bottom of said container for biasing and moving said movable plate upward in said container the length of one bobbin each time a yarn package is removed therefrom;

turntable means mounted on top of said base with said canister means removably positioned thereon for supporting and rotating said canister means;

a plurality of wheels mounted beneath said base, whereby movement of said base, said turntable means, and said canister means is facilitated; and an upright cylindrical casing fitted over said turntable means on said base within the circular arrangement of said cylindrical containers.

2. A device as claimed in claim 1, further comprising detecting means attached to said spinning machine for detecting a predetermined number of yarn packages sent to each container and for signalling said turntable means to rotate said containers thereon when said predetermined number is reached.

3. A device as claimed in claim 1, wherein said turntable means is comprised of:

a turntable;

a central pillar connected to said base and extending upward therefrom through said turntable;

bearing means surrounding said central pillar in contact with said turntable for rotatably supporting said turntable;

driving means connected between said central pillar and said turntable for rotating said turntable rotatably supported by said bearing means, said driving means comprised of:

a motor connected to said central pillar, gear means connected between said motor and said turntable for rotating and transmitting the output of said motor to said turntable, whereby said turntable is rotated on said bearing means; and rotational control device means connected to said driving means for controlling the amount of rotation of said turntable caused by said driving means.

4. A device as claimed in claim 3, wherein said rotational control device means is comprised of:

a gear meshing with said gear means connected between said motor and said turntable, said gear rotating one full revolution during a predetermined angle of rotation of said gear means;

a projection fixed to said gear and extending away therefrom; and motor control switching means operatively connected to said motor and positioned in the path of said projection on said gear for contacting said projection after said gear has rotated, whereby said switch is activated and said motor is stopped.

5. A device as claimed in claim 1, wherein said cylindrical containers are inclined at an angle toward said central axis against said upright cylindrical casing.

6. A device as claimed in claim 5, wherein said turntable means is comprised of:

a central pillar connected to said base and extending upward therefrom;

an outer annular member positioned above said base concentric with and surrounding said central pillar at a distance therefrom;

an inner annular member positioned above said base concentric with and surrounding said central pillar at a distance therefrom between said outer annular member and said central pillar;

bearing means surrounding and connected to said central pillar for rotatably supporting said inner annular member about said central pillar;

a boss fitted to said bearing means;

a plurality of connecting bars connected to said boss, extending radially outward therefrom and connected to said inner annular member, said connecting bars further extending to and connected to said outer annular member, whereby said inner and outer annular members are attached to said bearing means for rotation about said central pillar;

bearing roller means connected to said base beneath said inner annular member for slidably supporting said inner annular member above said base;

driving means connected between said central pillar and said boss for rotating said boss connected to said bearing means about said central pillar, said driving means comprised of:

a motor connected to said central pillar, and gear means connected between said motor and said boss for rotating and transmitting the rotational output of said motor to said boss, whereby said boss and said inner and outer annular members connected thereto are rotated; and rotational control device means connected to said driving means for controlling the amount of rotation of said boss caused by said driving means.

7. A device as claimed in claim 6, wherein said upright cylindrical casing fitted over said turntable means is fitted to said inner annular member; and said device is further comprised of:

a plurality of hook member means attached to the outside of said cylindrical casing at the bottom thereof adjacent said inner annular member for supporting the bottom rims of said cylindrical containers thereon; and ring member means of elastic material surrounding the upper rim of said cylindrical casing for cushioning the contact between said casing and said containers inclined thereagainst.

8. A device as claimed in claim 1, further comprising:

holding means connected to said upright cylindrical casing and extending outward therefrom for adjustably surrounding, at least partially, at least one of said containers surrounding said cylindrical casing and selectively preventing lateral movement of said containers.

9. A device as claimed in claim 8, wherein said holding means is comprised of:

a plurality of stationary members attached to said casing;

a movable member pivotally attached at one end thereof to each stationary member for upward and downward vertical movement, the free end thereof opposite the end attached to said stationary member extending at least partially around and engaging at least one of said containers when said movable member is pivoted upward on said stationary member, and the free end thereof being clear of said container when said movable member is pivoted downward; and spring means attached between said stationary member and each movable member for maintaining said movable member in position when said movable member is pivoted upward and downward.

10. A device as claimed in claim 8, wherein said holding means is comprised of:

a plurality of stationary members attached to said casing; and a movable member pivotally attached at one end thereof to each of said stationary members for rotational movement, the free end thereof opposite the end attached to said stationary member extending at least partially around and engaging at least one of said containers when said movable member is pivotally rotated horizontally with respect to said stationary member, and the free end thereof being clear of said said containers when said movable member is pivotally rotated vertically with respect to said stationary member.

* * * * *